United States Patent [19]

Bogese, II

[11] 4,424,403

[45] * Jan. 3, 1984

[54] CABLE ASSEMBLY HAVING SHIELDED CONDUCTOR AND METHOD AND APPARATUS FOR TERMINATING SAME

[75] Inventor: Stephen B. Bogese, II, Roanoke, Va.

[73] Assignee: Virginia Patent Development Corporation, Roanoke, Va.

[ * ] Notice: The portion of the term of this patent subsequent to Jul. 28, 1998, has been disclaimed.

[21] Appl. No.: 258,728

[22] Filed: Apr. 29, 1981

Related U.S. Application Data

[63] Continuation-in-part of Ser. No. 48,523, Jun. 14, 1979, Pat. No. 4,281,212.

[51] Int. Cl.[3] ..... H01B 11/06

[52] U.S. Cl. ..... 174/36; 174/106 SC; 174/117 F; 339/99 R

[58] Field of Search ..... 174/36, 103, 106 SC, 174/115, 117 F; 339/99 R

[56] References Cited

U.S. PATENT DOCUMENTS

| | | | |
|---|---|---|---|
| 2,211,584 | 8/1944 | Ruben | 174/102 |
| 2,518,789 | 8/1950 | Jackson | 200/143 |
| 3,291,891 | 12/1966 | Sharp | 174/103 X |
| 3,297,614 | 2/1972 | McClean et al. | 174/36 |
| 3,639,674 | 2/1972 | Stier | 174/36 |
| 3,775,551 | 11/1973 | Schumacher | 174/36 X |
| 3,794,752 | 2/1974 | Bunish et al. | 174/36 X |
| 3,816,644 | 6/1974 | Giffel et al. | 174/36 X |
| 4,002,392 | 1/1977 | Hardesty | 339/99 R |
| 4,025,715 | 5/1977 | Foley et al. | 174/36 |
| 4,234,759 | 11/1980 | Harlow | 174/104 |
| 4,314,737 | 2/1982 | Bogese et al. | 174/36 |

*Primary Examiner*—R. R. Kucia

*Attorney, Agent, or Firm*—Saidman, Sterne & Kessler

[57] ABSTRACT

A shielded conductor is formed by bonding a thin layer of conductive material to the outer surface of an insulated wire. The bonding may be achieved by coating the outside surface of the insulated wire with a metallic particle and solvent solution, and then heating the coated wire to flash off the solvent. A grounding conductor is disposed adjacent to the outer conductive layer and is in electrical contact therewith. The grounding conductor may take the form of a center ground wire surrounded by a semiconductive material whose outer diameter is substantially the same as that of the shielded conductor. One or more unshielded insulated conductors may also be provided within the cable assembly which is particularly designed to be terminated in a miniature, modular plug.

The cable assembly may also include a plurality of shielded conductors disposed in laterally adjacent relationship. Conductive coatings on adjacent shielded conductors are in electrical communication. Accordingly, all of the conductive coatings can be grounded through a single connection. The single connection may be effected by stripping back the conductive coatings on all but one of the shielded conductors. The conductors may then be terminated in a standard, miniature modular plug which utilizes insulation-piercing conductive terminals, in which one of the terminals pierces the unstripped conductor coating to define the grounding conductor.

24 Claims, 14 Drawing Figures

FIG. 1
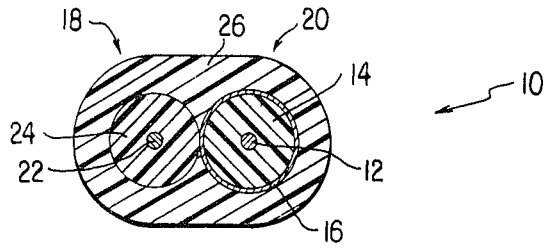
FIG. 2
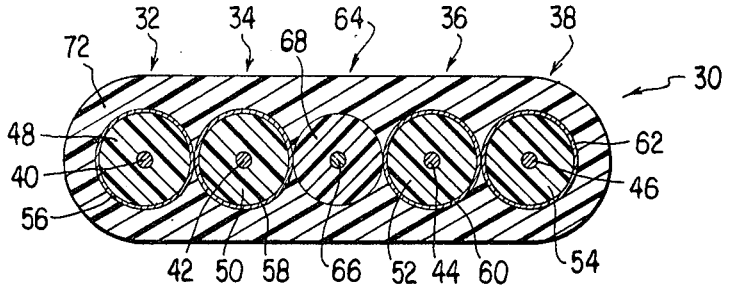
FIG. 3
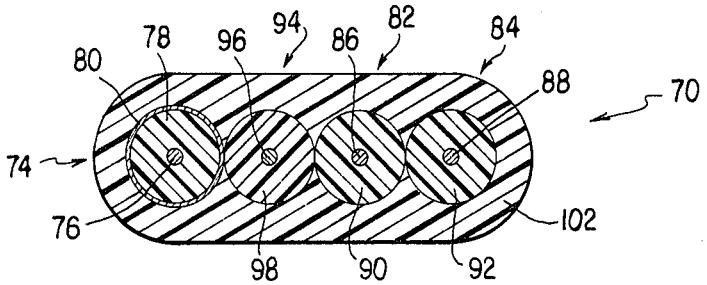
FIG. 4
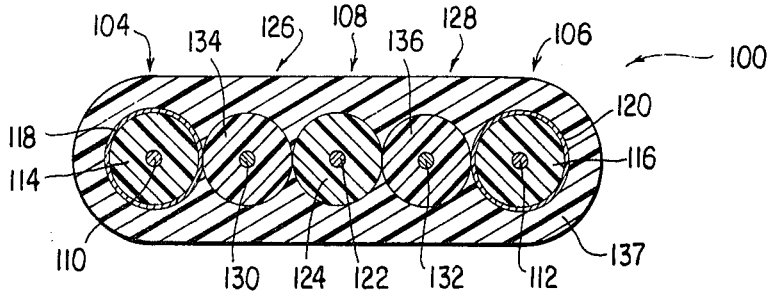
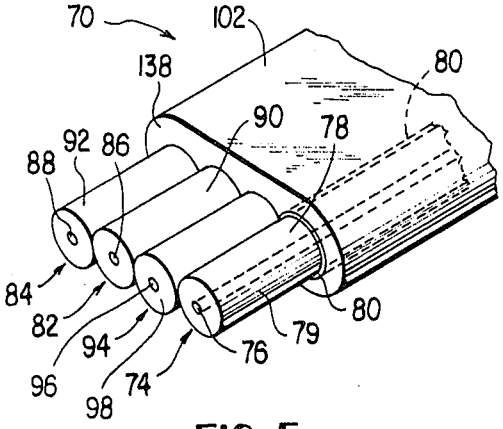
FIG. 5
FIG. 6
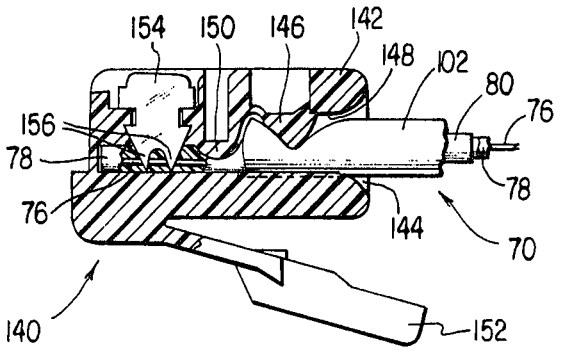

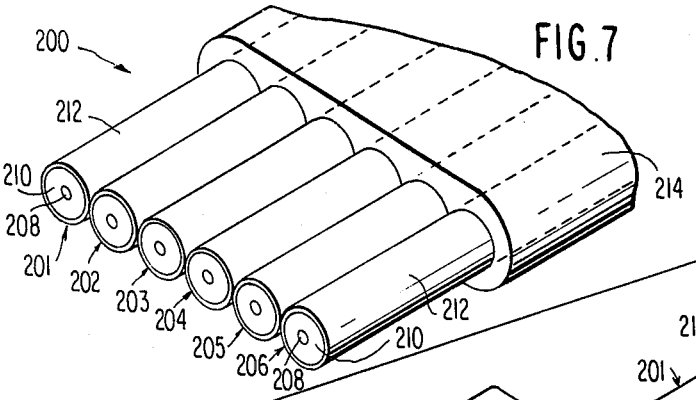
FIG. 7
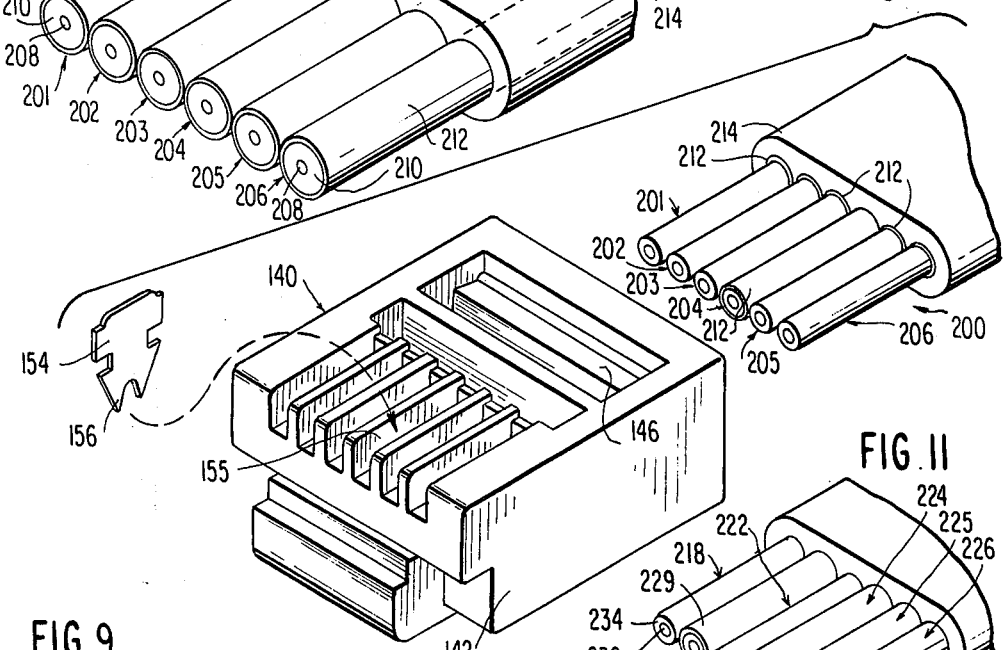
FIG. 8
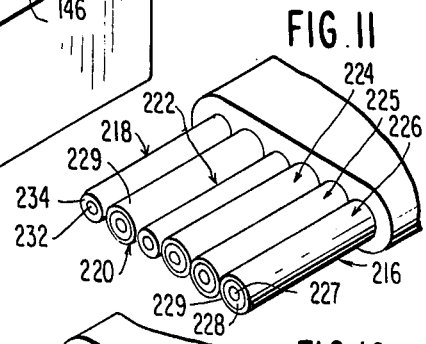
FIG. 11
FIG. 9
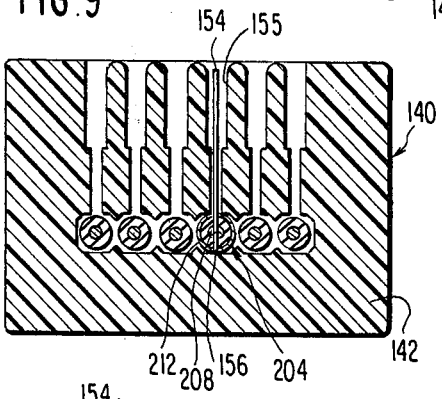
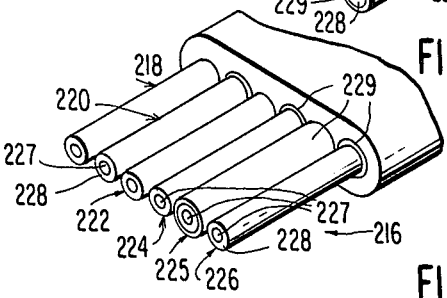
FIG. 12
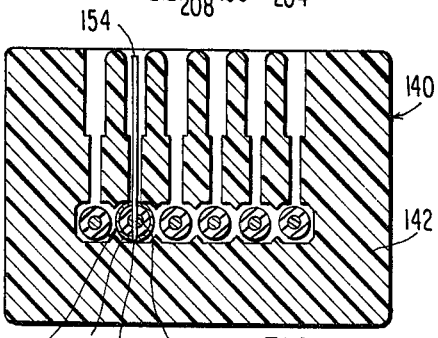
FIG. 10
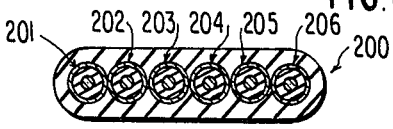
FIG. 13
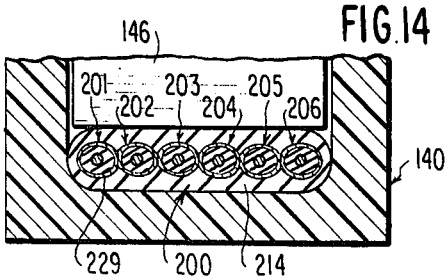
FIG. 14

CABLE ASSEMBLY HAVING SHIELDED CONDUCTOR AND METHOD AND APPARATUS FOR TERMINATING SAME

CROSS REFERENCE TO RELATED APPLICATION

This application is a continuation-in-part of U.S. patent application Ser. No. 48,523, filed June 14, 1979 which is U.S. Pat. No. 4,281,212 issued July 28, 1981.

BACKGROUND OF THE INVENTION

1. Field of the Invention

The present invention relates to cable constructions and, more particularly, is directed towards a cable assembly having at least one shielded conductor, as well as to a method of making and using same in combination with a standard, telephone-type modular plug.

2. Description of Related Art

A wide variety of cable assemblies that have one or more shielded conductors are known. Such cable assemblies are utilized in various applications where it is necessary to shield a low level, information-bearing electrical signal from spurious external electrical interference. It is well known that such shielding may be accomplished by surrounding the information carrying conductor with a metal shield that, in one fashion or another, is externally grounded. Such a grounded shield effectively prevents the signal on the wire from being distorted by externally generated electrical noise or other interference.

Miniature modular plugs and mating jacks have recently gained wide popularity, especially in the telephone industry. Such miniature plugs, as exemplified by U.S. Pat. No. 4,002,392 to Hardesty, are characterized by their ability to rapidly terminate a multi-conductor cable. A typical multi-conductor cable utilized with such plugs comprises a substantially planar array of conductors which are individually insulated and are then encapsulated in an outer jacket to maintain precise physical positioning thereof. A portion of the outer jacket is removed to expose the ends of the insulated conductors prior to insertion into a modular plug, and subsequent termination. Termination is achieved by individually piercing each of the insulated conductors with a small, flat insulation-piercing conductive terminal which becomes locked in place in the plug. The plug also includes means for securely gripping and thereby retaining the jacketed portion of the cable, and may also provide strain-relief means for the unjacketed terminated insulated conductors.

One advantage of the modular plugs described above is that, after termination of a multi-conductor cable therein, the plug may be rapidly connected and disconnected to a mating jack, as is well known in the art. An integral locking tab is provided on the plug for maintaining same securely within the jack, and for readily releasing the plug from the jack when desired.

While widely utilized in the telephone industry, such miniature plugs and jacks have a small but steadily increasing market in other applications, such as those which simply require a low signal level (e.g. 12 volts) interconnect cable between two pieces of electrical equipment. The low level signals on such cables frequently, however, must be transmitted in an environment where shielding of one or more of the insulated conductors is desirable, or even critical, to ensure preservation of the information content of the signals transmitted in the conductors. However, despite the growing need, a practical and inexpensive multi-conductor cable, having one or more shielded insulated conductors, which may be utilized with the popular miniature, modular telephone-style plugs, has yet to be developed.

Several different types of shielded cables are commonly known, but each suffers from one or more disadvantages as respects their costs, ease of termination, cable flexibility, or quick-disconnect ability. One common construction employs a plurality of metal strands which are either braided or wrapped in a spiral fashion about one or more insulated conductors. One disadvantage of such a construction is that the extra thickness of the metal strands makes the resulting shielded conductor considerably larger than an equivalent unshielded conductor. Thus, if both a shielded and unshielded conductor are jacketed in a single cable, the unequally sized conductors result in an unbalanced construction which is difficult to jacket smoothly and uniformly, and may therefore require specialized equipment for manufacture. Further, connection to the shield is slow and therefore quite costly from a labor standpoint. For a braided shield, for example, the individual braids must be manually unwoven, and then manipulated to one side of the cable and terminated, usually by soldering. For a wrapped shield, the wrapped strands must be unfurled from the insulated conductor, and then twisted together for termination. These types of constructions simply do not lend themselves to be rapidly terminated, especially in a miniature, modular, telephone-style plug which is designed to receive precisely aligned conductors of a predetermined size, and which also terminate the conductors by piercing the insulation, rather than by soldering. The oversized braided or wrapped shielded conductors described above simply do not fit into such modular plugs.

Another common type of shielded cable utilizes a semiconductive plastic material applied over one or more uninsulated conductors. The semiconductive material is generally extruded around the insulation of the conductor desired to be shielded. The thinnest wall thickness, however, that can be extruded is approximately 0.004 inch. While relatively thin when compared with the metal stranded shielded conductors described above, such a thickness nevertheless also results in an unbalanced construction and oversized conductors, thereby admitting of some of the same problems described above with respect to the metal strand shields. Further, connection techniques for such plastic shields have not been fully perfected and leave much to be desired from the standpoints of quality and reliability. These oversized shielded conductors also do not fit within the standard telephone-type modular plugs.

A third type of shielded cable assembly is exemplified by the construction described in U.S. Pat. No. 3,775,552 to Schumacher. Such a construction utilizes a metal foil and polymer laminate which surrounds both the insulated conductor and a drain wire which is externally grounded. The drain wire contacts the foil-polymer laminate to provide the desired shielding of the insulated conductor positioned therewithin. The presence of the drain wire causes the shielded conductor to be eccentric, making it larger than a corresponding unshielded conductor, which results in an unbalanced construction as described hereinabove for the other prior art assemblies. Further, the foil shield cannot be terminated without the metal drain wire. To attempt to utilize such as construction in a miniature, telephone-style modular plug would require the foil shield to be unfurled and then cut off along with the drain wire. More importantly, the cross-sectional geometry of such a cable does not at all lend itself to termination in such a plug.

U.S. Pat. Nos. 277,248, 2,211,584 and 3,297,490 deal with the application of a conductive coating on a single insulated wire.

Other prior art U.S. Pat. Nos. which relate generally to cable constructions or coatings include: 1,976,804; 2,161,947; 3,211,821; 3,594,228; 3,792,192; 4,079,156; 4,081,602; and 4,130,854.

OBJECTS OF THE INVENTION

It is therefore a primary object of the present invention to provide a novel and unique cable assembly having at least one shielded conductor which overcomes all of the disadvantages noted above with respect to prior art designs.

Another object of the present invention is to provide a cable assembly which includes at least one shielded conductor which is neither oversized nor results in an unbalanced cable construction when jacketed with other unshielded conductors.

A further object of the present invention is to provide a novel cable assembly wherein a shielded conductor may be provided having substantially the same outer diameter as an unshielded conductor, which results in a smooth and uniform cable that can be assembled with standard equipment and which further may be sized so as to easily fit in a standard, telephone-style, miniature, modular plug.

An additional object of the present invention is to provide a multi-conductor assembly which includes at least one shielded conductor, the cable assembly being particularly designed to be rapidly terminated in a miniature, modular, telephone-style plug.

A still further object of the present invention is to provide a novel and unique method of making a shielded conductor and cable assembly wherein the resultant product is more uniform and precisely sized than can be produced by prior art techniques.

A still additional object of the present invention is to provide a novel techique for making a shielded conductor which results in an extremely thin, yet effective, metallic shield being formed over a standard insulated conductor.

Another object of the present invention is to provide a cable assembly that utilizes a unique shielded conductor and means for grounding same which are both substantially uniform and equal size to permit use with existing cable assembly equipment that results in a uniform and precision end product for use with known cable terminating devices.

Another object of the present invention is to provide a novel and unique cable assembly with at least one shielded conductor which is extremely flexible, is easily terminated, and may be adapted to be utilized with a device for providing a quick-disconnect from electrical equipment.

Another general and important object of the present invention is to provide a cable assembly having at least one shielded conductor which is particularly designed for rapid termination in a standard miniature telephone-style plug so that the cable assembly may be utilized as a low signal level interconnect cable between various pieces of electrical equipment and which prevents spurious electrical interference from destroying the information content in the cable without substantially increasing the size thereof. An advantage which results from this feature is that standard tooling, wires and connectors, normally utilized only with unshielded conductor cables, may be readily employed during manufacture and use.

Another object of the present invention is to provide a cable assembly having a plurality of shielded conductors in which one of the shielded conductors acts as a ground wire for shielding the remaining shielded conductors.

SUMMARY OF THE INVENTION

The foregoing and other objects are attained in accordance with one aspect of the present invention through the provision of apparatus which comprises a first shielded wire assembly that includes conductive wire means for transmitting an electrical signal, insulation means for covering the wire means along its length, means for shielding the wire means against outside electrical interference which comprises a thin layer of conductive material bonded to the insulation means, and grounding means comprising a semiconductive material covering a ground wire and in contact with the thin layer of conductive material along its length. The apparatus may further include a second shielded wire assembly substantially identical to the first shielded wire assembly.

There is further provided jacket means in the form of an insulated jacket extruded over the semiconductive material and the shielded wire assemblies. The outer diameters of the semiconductive material and the insulation means are approximately the same. Further, the thickness of the layer of conductive material is preferably less than 0.001 inch and in a preferred embodiment is on the order of 0.0003–0.0004 inch. The conductive material comprises a metal, such as silver.

In accordance with another aspect of the present invention, the conductive material of the second shielded wire assembly may be in electrical contact with the conductive material of the first shielded wire assembly. Means may however be provided for electrically isolating the conductive material of the second shielded wire assembly from the conductive material of the first shielded wire assembly. Such electrical isolating means may comprise an additional conductive wire covered by an unshielded insulation and positioned between the first and second shielded wire assemblies. The means for grounding the layer of conductive material is also positioned between the unshielded wire assembly and the first shielded wire assembly, and the second shielded wire assembly includes a second conductive wire means covered by a second insulation means, and a second thin layer of conductive material bonded to the second insulation means. A second semiconductive material for grounding the second layer of conductive material may be positioned adjacent the second shielded wire assembly and in contact with the second layer of conductive material.

In accordance with another aspect of the present invention, a cable assembly is provided which comprises a plurality of shielcded wire assemblies and means for grounding same, each of the shielded wire assemblies including conductive wire means for transmitting an electrical signal, insulation means for covering the wire means along its length, and means for shielding the wire means against electrical interference which comprises a layer of conductive material bonded to the insulation means.

In accordance with other aspects of the present invention, a plurality of shielded wire assemblies may be disposed in laterally adjacent relationship so that the shields of adjacent wire assemblies are in electrically conductive contact. The shields on each of the shielded wire assemblies except for one may be stripped prior to termination in a standard modular plug. The shield on the unstripped wire assembly may then act as the grounding means for all the shielded wire assemblies.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, wherein:

FIG. 1 is a cross-sectional view of one preferred embodiment of the cable assembly of the present invention;

FIG. 2 is a cross-sectional view illustrating an alternate embodiment of the cable assembly of the present invention;

FIG. 3 is a cross-sectional view of yet another alternate embodiment of the cable assembly of the present invention;

FIG. 4 is a cross-sectional view of yet another alternate embodiment of the cable assembly of the present invention;

FIG. 5 is a perspective, fragmentary view of an end portion of the preferred embodiment of the present invention of FIG. 3 illustrated in a form ready for termination;

FIG. 6 is a side-sectional view illustrating the cable of FIG. 5 terminated in a standard, modular miniature telephone-style plug;

FIG. 7 is a perspective, fragmentary view of an end portion of an alternate embodiment of the cable assembly of the present invention in which a plurality of the wires are shielded;

FIG. 8 is a perspective view showing the cable of FIG. 7 just prior to termination in a miniature modular plug;

FIG. 9 is a transverse sectional view showing the cable of FIG. 7 terminated in a miniature modular plug;

FIG. 10 is a transverse sectional view similar to FIG. 9 but showing an alternate shielded conductor used as the grounding conductor;

FIG. 11 is a perspective, fragmentary view of an alternate embodiment of the cable assembly of the present invention;

FIG. 12 is a perspective, fragmentary view showing the cable assembly of FIG. 11 prepared for termination;

FIG. 13 is a transverse sectional view of the cable assembly of FIG. 7 prior to termination in a miniature modular plug; and FIG. 14 is a transverse sectional view showing the compressional deformation of the cable assembly of FIG. 13 after termination in a miniature modular plug.

DETAILED DESCRIPTION OF THE PREFERRED EMBODIMENTS

Referring now to the drawings, wherein like reference numerals represent identical or corresponding parts throughout the several views, and more particularly to FIG. 1 thereof, there is illustrated a first preferred embodiment of a cable assembly in accordance with the present invention that is indicated generally by reference numeral 10.

The cable assembly 10 comprises a single substantially cylindrical shielded wire assembly which is indicated generally by reference numeral 20. Positioned adjacent and in contact with the shielded wire assembly 20 is a substantially cylindrical ground wire assembly indicated generally by reference numeral 18. The ground wire assembly 18 and the shielded wire assembly 20 are both encapsulated in a standard manner within an insulating jacket 26, which is typically extruded over assemblies 18 and 20. Jacket 26 may, for example, comprise polyvinylchoride (PVC).

The shielded wire assembly 20 of the present invention comprises a center conductor or wire 12 which is designed to transmit a low level information-bearing signal which needs to be shielded from extraneous electrical interference in order to maintain the integrity of the information. Conductor 12 is surrounded by an insulation 14, which may typically comprise PVC, a polyolefin (such as polyethylene), or an elastomer.

In accordance with the present invention an extremely thin conductive layer 16 is bonded to the outside surface of insulation 14. The thickness of conductive layer 16 is somewhat exaggerated in the drawings, since it is preferably on the order of 0.0003–0.0004 inch. Generally, the thickness of the conductive layer 16, produced in a manner to be described in greater detail hereinafter, is less than 0.001 inch, sufficient to provide the desired low resistivity necessary to shield the low-level (e.g. 12 volt) signals on wire 12, and is typically around an order of magnitude thinner than the thinnest shields of the prior art.

The material from which conductive layer 16 is formed is preferably metallic, such as silver, copper, aluminum, or the like. Silver is presently preferred due to its high conductivity.

The ground wire assembly 18 preferably comprises a center conductor or wire 22 which is externally connected to ground. Ground wire 22 is surrounded by a semiconductive material 24, which is preferably formed of a semiconductive polymer, such as semi-conductive PVC or semiconductive polyethylene. Alternatively, a semiconductive rubber could be utilized. As is well known, a polymer or rubber can be made semiconductive by the addition of a high amount of conductive filler, such as carbon black. Such materials are well known in the art.

The semiconductive material 24 is in physical and electrical contact with the thin layer 16 of the shielded wire assembly 20 along its entire length to thereby provide an effectively grounded shield for the signal carrying conductor 12.

The diameter of the semiconductive material 24 is preferably substantially the same as that of the shielded wire assembly 20, which provides a uniform geometry over which the jacket 26 may be easily extruded by conventional techniques and equipment. Alternatively, however, the ground wire assembly 18 may consist of any suitable grounding means, such as a single drain wire, or the like. The configuration of FIG. 1 is preferred, however, both for its uniformity in construction and to facilitate termination, as will become more clear hereinafter.

The thin conductive layer 16 of the shielded wire assembly 20 may be formed of any of a number of techniques. In accordance with one method of the present invention, the wire 12 and insulation 14 are initially dipped in a liquid bath which consists of a mixture of fine metallic particles, such as silver, in a solvent. After being coated with the metal-solvent mixture, the insulation 14 is then placed in a heated chamber. The high temperature of the heated chamber flashes off the solvent and bonds the conductive layer 16 to the outside surface of insulation 14.

After heating, the shielded wire assembly 20 may be wound on a spool for temporary storage. Jacket 26 may be extruded about shielded wire assembly 20 and ground wire assembly 18 by conventional techniques and equipment.

Many different metal-solvent solutions may be uitlized within the scope of the present invention. The exact nature of the metal-solvent solution is not critical as long as the desired metal thickness and bond results. For example, conductive silver composition 4049 manufactured by E. I. DuPont De Nemours & Co. of Wilmington, Del., may be employed when utilizing a polyethylene or PVC insulation 14. Conductive silver composition 4049 comprised of 60% base pigment (silver), binder, and solvent, the latter being a benzyl alcohol. The silver-solvent solution is pre-packaged and ready to use, and may be placed in a tank through which the polyethylene insulation 14 is drawn. The thickness of the conductive layer 16 will generally be proportional to the time the insulation 14 is in the tank. For example, an immersion time of from approximately 15 to 20 seconds at room temperature provides a conductive layer 16 of approximately 0.0003–0.0004 inch.

After being withdrawn from the solution, the assembly 20 is drawn through a chamber heated at approximately 300° F. for approximately 60–120 seconds. This flashes off the solvent which results in the layer 16 being completely bonded to the outer surface of insulation 14. The finished product may then be wound onto a take-up spool.

If the insulation 14 comprises polyethylene, chemical or physical pre-treatment of the outer surface thereof may be desirable to enhance the adhesive bond of the conductive layer 16. For example, pre-treatment may be achieved by running the insulation 14 through a heated tunnel that causes the surface thereof to soften somewhat and thereby become tacky. This has been found to provide greater adhesion for conductive layer 16 to be subsequently coated thereon.

Alternatively, an intermediate pre-treatment material may be applied to the outer surface of insulation 14. Such pre-treatment material, while not attacking the outer surface of insulation 14, nevertheless provides a better surface to which the conductive layer 16 will bond. The thickness of a layer of such a pre-treatment material on insulation 14 is quite small, in fact, microscopic, and adds negligibly to the size of the finished product. A typical pre-treatment material which may be utilized with a polyethylene insulation is a chlorinated polyolefin manufactured by Eastman.

If, however, the insulation 14 comprises, for example, PVC, no pre-treatment thereof may be necessary, since PVC is readily attacked by the solvent in the metal-solvent bath to provide a microscopically rough surface to which the residual metal particles may readily bond.

As an alternative to chemical pre-treatment, the surface of insulation 14 may be flame treated to roughen the surface, without distorting same, to provide a better bond for the conductive layer 16.

As further alternatives to the coating and heating technique described hereinabove, the conductive layer 16 may be bonded to insulation 14 by, for example, vacuum metallization or vapor deposition, techniques that are well known in the art.

Referring now to FIG. 2, an alternate embodiment of a cable assembly in accordance with the present invention is indicated generally by reference numeral 30. Cable 30 comprises four substantially cylindrical shielded wire assemblies which are indicated generally by reference numerals 32, 34, 36 and 38. Each of the shielded wire assemblies 32–38 are analogous in construction to the shielded wire assembly 20 of FIG. 1. Each includes a center conductor or wire 40, 42, 44 and 46 respectively, which are surrounded by insulations 48, 50, 52 and 54. Thin conductive layers 56, 58, 60 and 62 are bonded onto the outer surfaces of insulations 48, 50, 52 and 54, respectively.

In the center of cable 30 is positioned a ground wire assembly 64, which is analogous in construction to ground wire assembly 18 of FIG. 1, and comprises a center ground conductor or wire 66 surrounded by a substantially cylindrical semiconductive material 68. Note that the semiconductive material 68 contacts metal shields 58 and 60 along their entire length, while metal shields 56 and 62 lie adjacent to and in physical and electrical contact with metal shields 58 and 60, respectively, so that each of the metallic layers 56–62 are properly grounded. A PVC jacket 72 may be extruded over all of the conductors to maintain proper physical and electrical contact. The cable 30 of FIG. 2 may be utilized where, for example, four information-bearing conductors 40, 42, 44 and 46 require shielding.

Referring now to FIG. 3, there is illustrated yet another alternative embodiment of a cable assembly in accordance with the present invention which is indicated generally by reference numeral 70. Cable assembly 70 comprises a single shielded wire assembly indicated generally by reference numeral 74 which includes a center conductor 76, an insulation 78 and a thin conductive layer 80 bonded to the outside surface of insulation 78.

Positioned adjacent shielded wire assembly 74 is a ground wire assembly 94 which comprises a grounded center conductor 96 surrounded by a semiconductive material 98 that is in physical and electrical contact with the thin metal layer 80 of the shielded wire assembly 74.

Cable 70 also includes a pair of unshielded wire assemblies indicated generally by reference numerals 82 and 84. Each of the unshielded wire assemblies 82 and 84 comprises a center conductor 86 and 88, respectively, surrounded by an insulation 90 and 92. The material of insulations 90 and 92 may be the same as that utilized for insulation 78 of shielded wire assembly 74, such as PVC, polyethylene, or the like.

The various assemblies 74, 82, 84 and 94 are arranged in a substantially planar array prior to jacketing by outer insulation 102. Unshielded wire assemblies 82 and 84 may be utilized for electrical energy transmissions which do not require shielding, such as, for example, power lines for indicator lights, or the like. Insulations 90 and 92 prevent electrical contact between conductors 86 and 88, as well as between assemblies 82, 84 and semiconductive material 98.

Referring now to FIG. 4, reference numeral 100 indicates a three-conductor cable assembly which comprises a pair of shielded wire assemblies indicated by reference numerals 104 and 106 which are positioned one on each end of the cable assembly 100. The third conductor cable is indicated by reference numeral 108 and comprises an unshielded wire assembly which electrically isolates shielded wire assemblies 104 and 106 by virtue of its positioning between ground wire assemblies 126 and 128.

The shielded wire assemblies 104 and 106 each include a center conductor 110 and 112 for carrying information-bearing electrical signals. Center conductors 110 and 112 are surrounded by substantially cylindrical insulations 114 and 116 to the outer surfaces of which are bonded conductive layers 118 and 120, respectively.

The shielded wire assembly 108 includes a center conductor 122 which may be utilized, for example, as an electrical power line, which is surrounded by substantially cylindrical insulation 124.

Ground wire assemblies 126 and 128 each include a center ground wire 130 and 132 which are respectively surrounded by substantially cylindrical semiconductive material 134 and 136.

The insulated conductors 104, 106 and 108 as well as the ground wire assemblies 126 and 128 are held in their physical and electrical relationship by an extruded outer jacket 137.

Referring now to FIG. 5, there is illustrated a perspective view of the cable 70 of FIG. 3 after having been prepared for termination. The jacket 102 is cut and stripped back approximately ⅜ inch from the ends of the uninsulated conductors 74, 82 and 84 and from ground wire assembly 94, leaving a substantially flat face 138. Further, the conductive layer 80 around shielded wire assembly 74 is removed from the exposed portion 79 of insulation 78. Layer 80 may be removed from exposed portion 79 of insulation 78 by scraping same with a cutting tool, such as a knife or the like, or may alternatively be removed by a grinding wheel or similar abrasive device. The resultant construction of FIG. 5 leaves the metallic layer 80 intact within jacket 102, still in physical and electrical contact with the semiconductive material 98 to provide shielding for that portion of center conductor 76 still within jacket 102. The exposed portion 79 is stripped of the metallic shield to prevent shorting of center conductor 76 during termination, as will now be described.

Referring now to FIG. 6, the cable of FIG. 5 is illustrated after installation in a standard, miniature, modular telephone-type plug 140. The details of construction of a typical modular plug 140 are fully described in U.S. Pat. No. 4,002,392, which is incorporated herein by reference.

Briefly, plug 140 includes a dielectric housing 142 having a cable input aperture 144 positioned at one end thereof. A jacket-anchoring member 146 is moved into the position illustrated in FIG. 6 after the cable 70 has been fully inserted into plug 140 through the aperture 144. Anchoring member 146 is locked in position by bearing against the edge or corner 148 of housing 142 and serves to lock the cables 70 in place.

Plug 140 may also be provided with a strain relief element indicated by reference numeral 150. Strain relief element 150 is also moved to the position shown in FIG. 6 after the cable 70 has been fully inserted and terminated.

A resilient locking tab 152 extends integrally from the dielectric housing 142 to permit the plug 140 to be removably locked to a suitable matching miniature jack (not illustrated), as is well known to a person skilled in the art.

Plug 140 also includes a plurality of conductive terminals 154, which preferably comprise gold-plated bronze for high conductivity. In the view of FIG. 6, only one such terminal 154 is shown, although a plurality of such terminals, one for each of the insulted conductors, are provided.

The conductive terminal 154 includes insulation piercing tangs 156 to provide an electrical connection between each conductor, such as conductor 76 of shielded wire 74, and terminal 154 which, in turn, is adapted to make electrical contact with a mating terminal in a miniature jack.

It should be apparent from FIG. 6 that the pre-stripping of the outer metal shield 80 from the exposed portion 79 of insulation 78 of shielded wire assembly 74 prevents the conductive terminal 154 from shorting the wire 76 to the shield 80. Further, the cable 70 of the present invention is sized and particularly designed to fit within the modular plug 140. This adaptability is made feasible by the extremely thin conductive layer 80, the sizing of the semiconductive ground 94 as well as the overall symmetrical cable construction which is no larger than an ordinary multi-conductor unshielded wire cable. It is understood that other shielded cable configurations, in addition to cable 70 of FIG. 3, may be adapted to be terminated in a modular plug, as the particular application may dictate.

Referring now to FIG. 7, reference numeral 200 indicates a six conductor flat cable assembly. Cable assembly 200 includes six shielded wire assemblies 201–206 which are exactly alike in construction. The six wire assemblies 201–206 are held in laterally adjacent contiguous relation by jacket 214 which may be formed from PVC or the like and may be extruded over all of the wire assemblies.

Each of the shielded wire assemblies 201–206 comprises an inner conductive wire 208 which is designed to transmit a low level information-bearing signal. Wire 208 is surrounded by an insulation layer 210 which may typically comprise PVC or any suitable insulator. An extremely thin conductive layer 212 is bonded to the outside surface of insulation 210. It should be noted that the conductive layer 212 of each of the wire assemblies 201–206 is held in electrical contact with the conductive layer 212 of the immediately adjacent wire assembly. Accordingly, electrical conductivity exists through all of the conductive layers 212 and, therefore, all of the conductive layers 212 may be grounded by a ground termination connected to any one of the conductive layers 212.

Cable 200 provides certain distinct advantages over alternate embodiments of the invention. For instance, one of the wire assemblies 201–206 may be chosen to be used as the grounding conductor for grounding the conductive layers of the remaining wire assemblies. It is therefore possible for a user of the cable to easily adapt the cable to interface with a large number of cable assemblies or equipment variations, where the desired position of the grounding conductor may not be known in advance. Further, a cable supplier need stock only one type of cable rather than a plurality of various cable configurations.

FIG. 8 demonstrates the manner in which cable assembly 200 can be terminated in miniature modular plug 140. As shown in FIG. 8, wire assembly 204 is chosen to be the grounding conductor for the cable assembly. Accordingly, conductive layers 212 on all wire assemblies except for wire assembly 204 are stripped back to the point where the wire assemblies emerge from jacket 214. It will be understood that jacket 214 has previously been stripped from the wire assemblies to expose free ends thereof which are sufficient in length to be received in miniature modular plug 140.

Plug 140 is of conventional design as discussed hereinabove. Termination of the cable 200 is accomplished in modular plug 140 by inserting each of the wire assemblies 201–206 in appropriate receiving channels in the modular plug. After insertion, jacket anchoring member 146 is moved into position engaging jacket 214 and deforming the cable assembly 200. A conductive terminal 154 is disposed in an associated receiving slot 155. The terminal is forced downwardly into the slot until piercing tangs 156 engage the wire assembly disposed immediately below the slot. It will be noted that only one conductive terminal 154 is shown in FIG. 8. However, a plurality of such terminals, one for each of the wire assemblies, are provided.

FIG. 9 shows wire assembly 204 after it has been completely terminated within modular plug 140. In FIG. 9, it can be seen that the tangs 156 of conductive terminal 154 pierce the conductive layer 212 thus making electrical contact therewith. Further, the tangs extend completely through wire assembly 204 and pierce the inner conductive wire 208 thus establishing electrical conductivity between the conductive layer 212 and the inner conductive wire 208. This electrical conductivity is not essential for operation of the invention but does allow the user the option of either connecting conductive terminal 154 to a mating ground terminal or leaving terminal 154 unconnected to a mating terminal. In the latter case, the opposite end (not shown) of inner conductive wire 208 of wire assembly 204 can be grounded in any conventional manner to complete the grounding of all conductive coatings 212.

FIG. 10 shows cable assembly 200 terminated in a miniature modular plug 140. FIG. 10 is similar in all respects to FIG. 9 except that wire assembly 202 is used as the grounding conductor. FIG. 10 demonstrates the versatility of cable assembly 200, in that but a single, uniform cable assembly (FIG. 7) need be manufactured and the end user may select the position of the grounding conductor according to his requirements. It will be noted that, as discussed above, a conductive terminal 154 is inserted in an associated receiving slot and forced downwardly to make electrical contact with conductive layer 212 of wire assembly 202. The tangs 156 are forced through the conductive layer into center wire conductor 208. Again, it is noted that tangs 156 do not necessarily have to make contact with center wire conductor 208 but such contact is desirable to provide the user greater flexibility in use of the cable and plug combination.

FIG. 11 shows an alternate embodiment of the cable assembly of the present invention generally referred to by the reference numeral 216. Cable assembly 216 is similar to cable assembly 200 in that cable assembly 216 contains a plurality of shielded wire assemblies 220, 224, 225 and 226. However, cable assembly 216 additionally contains an insulated conductor 222 and a ground wire assembly 218.

Shielded wire assemblies 220 and 224–226 each comprise a center conductive wire 227 surrounded by an insulation layer 228 with a conductive coating 229. Shielded wire assemblies 224–226 are in laterally adjacent relationship and the conductive coatings 229 of adjacent shielded wire assemblies are held in electrical conductive relationship. Accordingly, any one of shielded wire assemblies 224–226 can be used as the ground wire assembly.

Shielded wire assembly 220 has a conductive coating 229 which is electrically isolated from the conductive coatings of shielded wire assemblies 224–226 by the interposition of insulated conductor 222. The conductive layer 229 of shielded wire assembly 220 is grounded through ground wire assembly 218. Ground wire assembly 218 preferably comprises a center conductive wire 232 which is externally connected to ground. Wire 232 is surrounded by a semiconductive material 234 which is preferably formed of a semiconductive polymer or the like.

FIG. 12 shows cable assembly 216 prepared for termination in a miniature modular plug. It will be noted that shielded wire assembly 225 has been chosen as the ground wire assembly for grounding the conductive layers of wire assemblies 224 and 226. Accordingly, the conductive layers 229 of wire assemblies 224 and 226 have been stripped back but the conductive layer 229 of wire assembly 225 has not been stripped back. Similarly, the conductive layer 229 of wire assembly 220 has been stripped back since that conductive layer will be grounded through grounding wire assembly 218.

FIG. 13 shows a transverse sectional view of cable 200 taken through the jacket 214 prior to termination in miniature modular plug 140. It will be noted that cable assembly 200 is generally flat with each of the wire assemblies 201–206 being generally circular in cross-section. FIG. 14 depicts the deformation of the cable after termination in miniature modular plug 140. FIG. 14 shows jacket anchoring member 146 moved into its operative position engaging jacket 214 of cable assembly 200. Engagement of anchoring member 146 with the jacket 214 causes a compressional force to be exerted on cable assembly 200. Cable assembly 200 is thus transversely elongated within miniature plug 140. Similarly, each of the wire assemblies 201 through 206 is transversely elongated taking on a generally oval shape in cross-section. Such transverse elongation of the wire assemblies causes the conductive coating 229 of each wire assembly to more positively engage the conductive coating 229 of directly adjacent wire assemblies thus ensuring that electrical conductivity between the conductive coatings will be maintained.

Obviously, numerous modifications and variations of the present invention are possible in light of the above teachings. It is therefore to be understood that within the scope of the appended claims the invention may be practiced otherwise than as specifically described herein.

I claim as my invention:

1. Apparatus, which comprises:

a cable assembly comprising a plurality of shielded wire assemblies, each of said shielded wire assemblies including: conductive wire means for transmitting an electrical signal; insulation means for covering said wire means along its length; and means for shielding said wire means against electrical interference which comprises a thin metal layer of conductive material bonded to said insulation; said plurality of shielded wire assemblies being disposed in laterally adjacent relation, said thin metal layers on adjacent shielded wire assemblies being in electrically conductive contact;

miniature modular plug means for terminating said cable assembly; and wherein said thin metal layer on at least one of said shielded wire assemblies is stripped back to expose an unshielded end, said unshielded end being received and terminated by said modular plug means, and wherein another of said shielded wire assemblies has a shielded end containing said thin metal layer, said shielded end being received in and terminated by said modular plug.

2. The apparatus as defined in claim 1, wherein said modular plug means includes a plurality of thin conductive terminals, one thin conductive terminal being associated with and piercing each of said received wire assemblies, the thin conductive terminal associated with said shielded end being in electrically conductive contact with said thin metal layer on said shielded end.

3. The apparatus as defined in claim 2, wherein said modular plug means further includes a retaining member for engaging said cable assembly and holding said cable assembly in compressional engagement within said modular plug means thereby transversely elongating said cable assembly and increasing electrical conductivity between thin metal layers on adjacent shielded wire assemblies.

4. The apparatus as defined in claim 1, wherein said cable assembly is a substantially planar multiconductor cable.

5. The apparatus as defined in claim 1, wherein said cable assembly contains only shielded wire assemblies.

6. The apparatus as defined in claim 1, wherein said cable assembly further includes at least one unshielded insulated conductor.

7. The apparatus as defined in claim 6, wherein said cable assembly contains an additional shielded wire assembly, said at least one insulated conductor electrically isolating said additional shielded wire assembly from said plurality of shielded wire assemblies.

8. The apparatus as defined in claim 7, further including grounding wire means for grounding the thin metal layer of said electrically isolated additional shielded wire assembly.

9. Apparatus, which comprises:

a cable assembly comprising a plurality of wire assemblies and at least one shielded wire assembly, said wire assemblies and said shielded wire assembly each including conductive wire means for transmitting an electrical signal and insulation means for covering said wire means along its length; said shielded wire assembly further including means for shielding same against electrical interference which comprises a thin metal layer of conductive material bonded to the insulation means of said shielded wire assembly; said plurality of wire assemblies being disposed in laterally adjacent relation;

miniature modular plug means for terminating said cable assembly; and wherein said thin metal layer on said shielded wire assembly is stripped back to expose an unshielded end comprising conductive wire means and associated insulation means, said unshielded end being received and terminated by said modular plug means.

10. The apparatus of claim 9, further comprising means positioned adjacent and in electrically conductive contact with said shielded wire assembly for grounding said thin metal layer.

11. The apparatus of claim 10, wherein said grounding means comprises a ground wire covered by a semiconductive material.

12. Apparatus, which comprises:

a cable assembly comprising a plurality of wire assemblies and at least one shielded wire assembly, said wire assemblies including conductive wire means for transmitting an electrical signal and insulation means for covering said wire means along its length; said shielded wire assembly including means for shielding same against electrical interference which comprises a thin metal layer of conductive material bonded to the insulation of said shielded wire assembly; said plurality of wire assemblies being disposed in laterally adjacent relation;

miniature modular plug means for terminating said cable assembly; and wherein said thin metal layer on said shielded wire assembly is stripped back to expose an unshielded end, said unshielded end being received and terminated by said modular plug means;

further comprising means positioned adjacent and in electrically conductive contact with said shielded wire assembly for grounding said thin metal layer; and wherein said grounding means comprises a second shielded wire assembly identical to said at least one shielded wire assembly except that said thin metal layer of said second shielded wire assembly is not stripped back but forms a shielded end that is terminated in said modular plug.

13. The apparatus as defined in claim 12, wherein said modular plug means includes a plurality of thin conductive terminals, one thin conductive terminal being associated with and piercing each of said wire assemblies and said shielded wire assemblies, the thin conductive terminal associated with said shielded end being in electrically conductive contact with said thin metal layer on said shielded end.

14. Apparatus which comprises:

a cable assembly comprising a plurality of shielded wire assemblies, each of said shielded wire assemblies including: conductive wire means for transmitting an electrical signal; insulation means for covering said wire means along its length; and means for shielding said wire means against electrical interference which comprises a thin metal layer of conductive material bonded to said insulation; said plurality of shielded wire assemblies being disposed in laterally adjacent relation, said thin metallic layers on adjacent shielded wire assemblies being in electrically conductive contact; and wherein said thin metal layer on at least one of said shielded wire assemblies is stripped back upon termination to expose an unshielded end comprising said conductive wire means and associated insulation means.

15. The apparatus as set forth in claim 14, further comprising means for grounding said at least one shielded wire assembly.

16. The apparatus of claim 15, wherein said grounding means is positioned in electrically conductive contact with said at least one shielded wire assembly.

17. The apparatus of claim 16, wherein said grounding means comprises a ground wire covered by a semiconductive material.

18. Apparatus, which comprises:

a cable assembly comprising a plurality of shielded wire assemblies, each of said shielded wire assemblies including: conductive wire means for transmitting an electrical signal; insulation means for covering said wire means along its length; and means for shielding said wire means against electrical interference which comprises a thin metal layer of conductive material bonded to said insulation; said plurality of shielded wire assemblies being disposed in laterally adjacent relation, said thin metallic layers on adjacent shielded wire assemblies being in electrically conductive contact; and wherein said thin metal layer on at least one of said shielded wire assemblies is stripped back upon termination to expose an unshielded end;

further comprising means for grounding said at least one shielded wire assembly; and wherein said grounding means is positioned in electrically conductive contact with said at least one shielded wire assembly; and wherein said grounding means comprises a second shielded wire assembly identical to said at least one shielded wire assembly except that the thin metal layer of said second shielded wire assembly is not stripped back but forms a shielded end.

19. A cable which comprises:

a first conductor comprising an electrically conductive wire having in insulation covering thereon and a thin metallic layer of conductive material bonded to said insulation for shielding said wire against outside electrical interference;

a second conductor comprising an electrically conductive wire having a semi-conductive covering thereon;

a third conductor substantially identical to said first conductor;

a fourth conductor substantially identical to said second conductor;

said semi-conductive covering of said second conductor contacting said layer of conductive material of said first conductor along its length;

said semi-conductive covering of said fourth conductor contacting said layer of conductive material of said third conductor along its length;

a fifth conductor comprising an electrically conductive wire having an insulation covering thereon;

said fifth conductor electrically insulating said first and second conductors from said third and fourth conductors;

said first, second, third, fourth and fifth conductors being of approximately equal diameters and arranged to form a substantially flat cable; and an insulating outer covering over all of said conductors.

20. A cable as set forth in claim 19, wherein said layer of conductive matierial has a thickness less than 0.001 inch.

21. A cable as set forth in claim 19, wherein said layer of conductive material has a thickness on the order of 0.0003–0.0004 inch.

22. A cable as set forth in claim 21, wherein said layer of conductive material comprises silver.

23. A cable which comprises:

a plurality of sets of conductors, each set comprising;

a first conductor comprising a conductive wire, insulation covering said wire, and a thin metal layer of conductive material bonded to said insulation for shielding said wire from electrical interference; and at least one second conductor comprising an electrically conductive wire having a semi-conductive covering thereon;

said second conductor contacting said first conductor along its length for grounding said layer of conductive material;

said first and second conductors having substantially equal outer diameters;

said plurality of sets being arranged to form a substantially flat cable, and an insulating jacket covering said plurality of sets.

24. A cable as set forth in claim 23, further comprising at least one additional conductor within said insulating jacket, said additional conductor comprising an electrically conductive wire and an insulating covering thereon.

* * * * *